United States Patent [19]

Kalb

[11] Patent Number: 5,020,839

[45] Date of Patent: Jun. 4, 1991

[54] CONTAINER TENSION RING CLOSURE

[75] Inventor: Alfred Kalb, Neuwied, Fed. Rep. of Germany

[73] Assignee: Mauser-Werke GmbH, Bruehl, Fed. Rep. of Germany

[21] Appl. No.: 455,684

[22] Filed: Dec. 22, 1989

[30] Foreign Application Priority Data

Dec. 22, 1988 [DE] Fed. Rep. of Germany ..... 8815876

[51] Int. Cl.[5] ..... B65D 45/34

[52] U.S. Cl. ..... 292/256.69; 220/321; 24/272

[58] Field of Search ..... 220/319, 320, 321; 24/68, 68 E, 270, 271, 272; 285/409; 292/256.69

[56] References Cited

U.S. PATENT DOCUMENTS

| | | | |
|---|---|---|---|
| 1,517,196 | 11/1924 | Cuppett | 24/272 |
| 1,579,719 | 4/1926 | Lavender | 24/272 |
| 2,005,341 | 6/1935 | Jesser | 292/256.69 |
| 2,319,762 | 5/1943 | Bruning et al. | 292/256.69 |
| 2,680,536 | 6/1954 | Kojan | 292/256.69 |

FOREIGN PATENT DOCUMENTS

| | | | |
|---|---|---|---|
| 2602888 | 7/1977 | Fed. Rep. of Germany | 292/256.69 |
| 2908602 | 9/1980 | Fed. Rep. of Germany . | |
| 2916659 | 11/1980 | Fed. Rep. of Germany . | |
| 745428 | 2/1933 | France | 292/256.69 |
| 522675 | 9/1953 | France | 220/321 |
| 481801 | 1/1970 | Switzerland | 292/256.69 |
| 483345 | 2/1970 | Switzerland | 292/256.69 |
| 743339 | 1/1956 | United Kingdom | 220/321 |

*Primary Examiner*—Eric K. Nicholson

*Attorney, Agent, or Firm*—Pennie & Edmonds

[57] ABSTRACT

A tension ring closure device for containers having a lever means for drawing together opposite ends of the ring for closure. The ring may be locked by means of a shackle extending from the ring through the tensioning lever and a second shackle-like loop extending from one end of the ring and through an opening in the other ring end.

2 Claims, 1 Drawing Sheet

FIG. 1
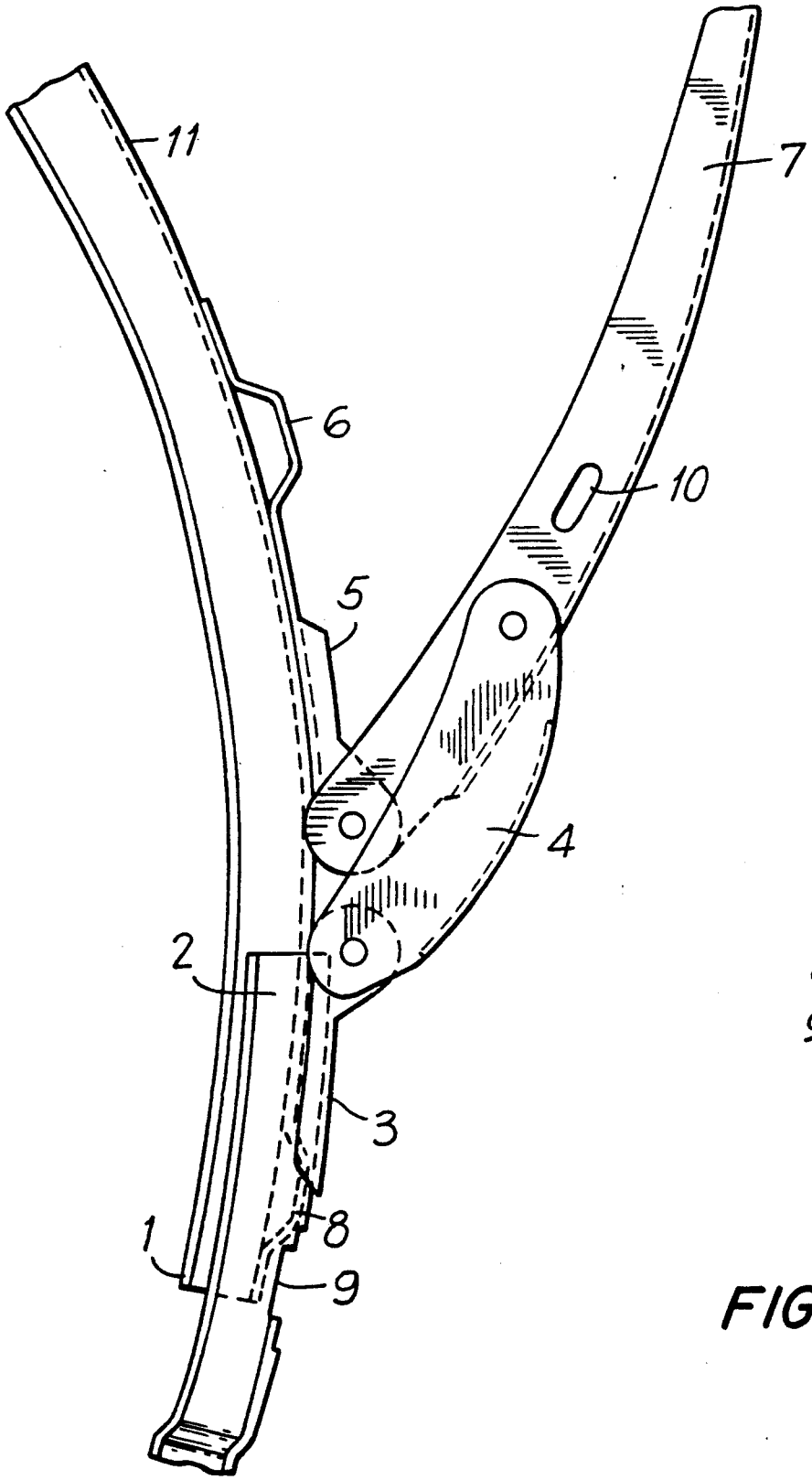
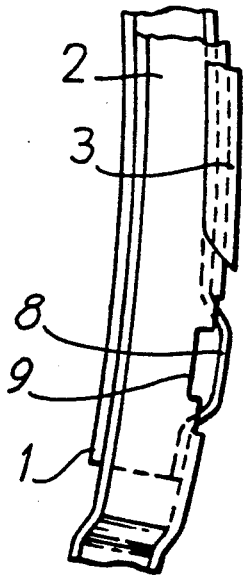
FIG. 2

CONTAINER TENSION RING CLOSURE

TECHNICAL FIELD

The invention relates to container closures and more particularly to a container tension ring closure whose ring ends are clamped one over the other in the locked position by means of a tension lever closure, the tension lever being secured against unauthorized opening.

BACKGROUND OF THE INVENTION

In closures of this kind, the application of the tightening force is performed by means of a tension lever pivoted on one end of the tension ring, and by means of a connecting link pivoted on the other end of the tension ring and on the tension lever. To secure the closure, the ring end that is joined directly to the tension lever has a shackle to accommodate a safety lock. The safety lock is threaded through lateral eyes in the tension lever when the tension lever is in the folded-down, locking position.

The securing of the tension lever to assure the originality of the packaging as described above provides a degree of strengthening of the closure under severe handling conditions. However, this strengthening is not considered sufficient, especially when a filled container is dropped. The tension ring ends overlap and one is clamped by a securing means, but the other ring end remains unsecured and is able to slip out and open up when the container is dropped. Thus, the means for security against unintentional opening, the shackle and safety lock, act virtually like a pivot around which the free ring end unwinds. The closure is thus destroyed.

SUMMARY

Accordingly, it is an object of the invention to stabilize a tension ring closure of the above kind in order to eliminate any such pivoting action.

This is achieved in accordance with the invention by providing the end of the lower end of the ring with a raised locking loop or shackle. When the tension ring is in the locked position with the ring ends overlapping, the raised locking loop projects through an opening in the overlapping ring end and serves to accommodate a safety ring or lock. By this measure the two ring ends can be deformed only together, not just one end alone.

BRIEF DESCRIPTION OF THE DRAWINGS

An embodiment of the invention is represented by way of example in the drawing, wherein:

FIG. 1 shows a tension ring in the open position and with the tension ring closer disposed thereon; and FIG. 2 shows a detail of a portion of the tension ring in the locked position.

DETAILED DESCRIPTION OF THE INVENTION

Referring to FIG. 1, lower and upper ends 1, 2 of the tension ring 11 are placed one over the other so that upper end 2 comes to lie on top of lower end 1. The application of the tensioning force is performed through a tension lever 7 which is pivoted at one end on a first fulcrum bracket 5 mounted on the lower end 1 of the tension ring. The transmission of the closing force takes place by way of a connecting lever 4, which is pivoted firstly to the tension lever 7 and secondly to a second fulcrum bracket 3 mounted on the upper end 2 of the tension ring.

When the lower ring end 1, joined to the tension lever 7, is in the locked position, a safety ring is passed through the lateral eye 10 of the tension lever 7 and through a lateral opening defined by loop 6. Referring to FIG. 2, close to the end of the lower ring end 1 there is disposed a raised shackle 8 which reaches through a window-like opening 9 in the upper ring end 2. A second safety ring or lock may be passed through the lateral opening of the raised shackle 8, to rest against the upper surface of ring end 2, thereby providing the necessary additional security.

What is claimed is:

1. An improved tension ring closure for containers, the ring having upper and lower ends clamped one over the other in a locked position by a tension lever closure means with the closure means including lever members disposed adjacent to ends of the ring and pivotally connected together, and in which the improvement characterized in that, when the ring ends (1, 2) are overlapping, an upwardly reaching locking loop (8) on the lower ring adjacent the lower ring end (1) is disposed at a location spaced circumferentially from and independent of said tension lever closure means; and a window-like opening (9) on the upper ring adjacent the upper ring end (2) is disposed at a location spaced circumferentially from and independent of said tension lever closure means for receiving the locking loop therethrough when the ends of the ring are clamped in locked position, said locking loop being exposed for reception therein of a locking device when the ring is in said locked position.

2. An improved tension ring closure for containers having open and locked positions including a ring (11) with upper and lower overlapping ends (2, 1), and a tensioning means (3, 4, 5, 7) mounted on the ring (11) and disposed near the upper and lower overlapping ends (2, 1), said tensioning means comprising a first fulcrum bracket mounted on the ring disposed near the lower end, a second fulcrum bracket mounted on the ring disposed near the upper end, a tensioning lever pivotably mounted at one end on the first fulcrum bracket, and a connecting lever linking the tensioning lever to the second fulcrum bracket by means of pivotable connections, the improvement wherein:

(a) the ring (11) defines a window-like opening (9) disposed near the upper end (2) of the ring (11) and circumferentially spaced from and independent of said tensioning means; and (b) the ring (11) has extending outwardly therefrom a loop (8) disposed near the lower end (1) of the ring (11) circumferentially spaced from and independent of said tensioning means and aligned with and extending through the window-like opening (9) when the ring (11) is in the locked position whereby a locking device may be inserted through the outwardly extending loop.

* * * * *